United States Patent [19]

Sevastakis

[11] 4,178,982

[45] Dec. 18, 1979

[54] METHOD AND APPARATUS FOR CONTINUOUSLY CASTING HOLLOW BARS

[76] Inventor: Gus Sevastakis, 5645 Angola Rd., Toledo, Ohio 43615

[21] Appl. No.: 846,423

[22] Filed: Oct. 28, 1977

[51] Int. Cl.[2] ..... B22D 11/04

[52] U.S. Cl. ..... 164/85; 164/421; 164/443

[58] Field of Search ..... 164/85, 421, 422, 137, 164/339, 342, 443

[56] References Cited

U.S. PATENT DOCUMENTS

| | | | |
|---|---|---|---|
| 925,686 | 6/1909 | Danver et al. | 164/137 |
| 3,331,430 | 7/1967 | Earl, Jr. | 164/85 X |
| 3,340,924 | 9/1967 | Ludwig | 164/421 |
| 3,593,773 | 7/1971 | Vogt et al. | 164/421 |
| 3,707,439 | 12/1972 | Poeste et al. | 164/85 X |
| 3,710,840 | 1/1973 | Fabens, Jr. | 164/85 X |

FOREIGN PATENT DOCUMENTS

| | | | |
|---|---|---|---|
| 46-12621 | 4/1971 | Japan | 164/85 |
| 47-34581 | 8/1972 | Japan | 164/85 |
| 718046 | 11/1954 | United Kingdom | 164/342 |

*Primary Examiner*—Robert D. Baldwin
*Assistant Examiner*—J. Reed Batten, Jr.
*Attorney, Agent, or Firm*—William E. Mouzavires

[57] ABSTRACT

Method and apparatus for continuously casting hollow bars in which a one-piece mandrel is suspended from a support bar secured across the top of a female die by a retaining ring which holds down the female die. A cooler surrounds the female die and the retaining ring is fixed to the cooler. The mandrel extends axially within the female die, and the mandrel support bar leaves relatively large crescent-shaped pouring areas permitting easy access by a pouring spout which dispenses molten metal directly into the space between the female die and the mandrel. Quick connect and disconnect fasteners are employed to secure the support bar to the retaining ring so as to facilitate replacement of the mandrel during a casting operation. A pair of guide pins is also provided to facilitate and center installation of the mandrel.

12 Claims, 4 Drawing Figures

FIG.1
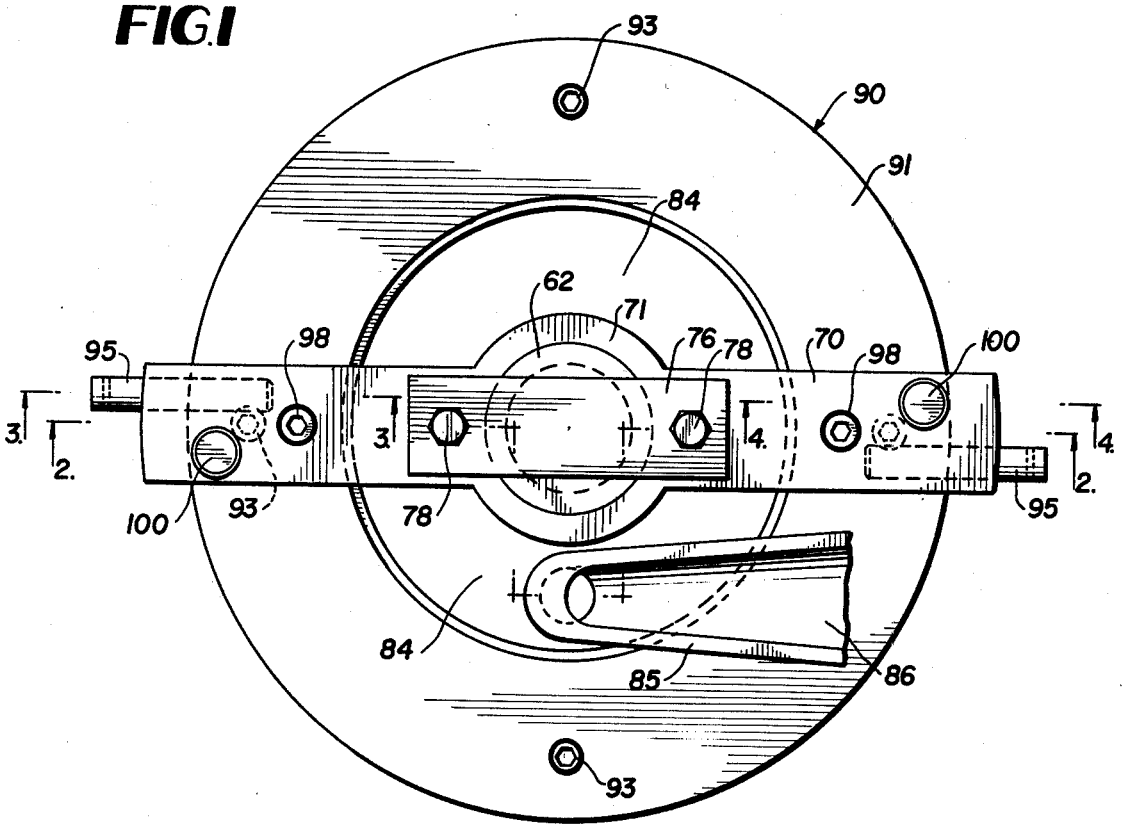
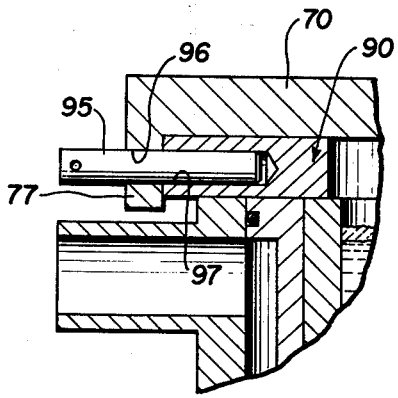
FIG.3
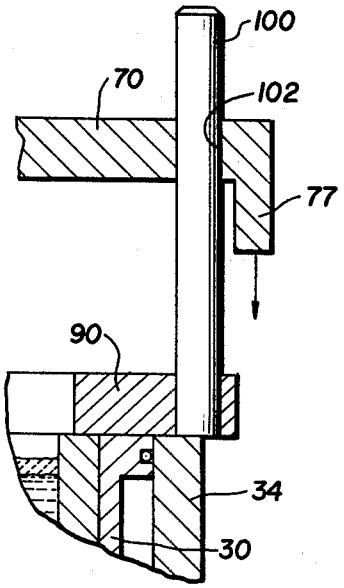
FIG.4

METHOD AND APPARATUS FOR CONTINUOUSLY CASTING HOLLOW BARS

BACKGROUND OF INVENTION

Conventional or prior art molding apparatus for continuously casting hollow bars commonly employ mandrels which are formed with pouring apertures or passages for receiving the molten metal to eventually be discharged in the space between the female die and the mandrel. Because of the space requirement in the mandrel to accommodate the pouring passages or apertures, the size of the mandrel in many cases does not permit the casting of hollow bars having relatively small internal diameters. Moreover, when pouring molten metal at 2100° F., for example, molten copper, the mandrel becomes susceptible to heat damage, particularly if the mandrel is weakened by pouring passages or apertures. Such damage can, of course, require premature replacement of the die and mandrel which, of course, increases the cost of production. To avoid such damage, special metals or materials having a high melting point and strength at that point may be utilized, however, such special metals may significantly increase the cost of the mandrel. The latter factor becomes more serious when it is considered that mandrels and dies must be replaced on a periodic basis due to the high temperature encountered in use. Also the down time and labor will increase the cost of the casting operation.

Pouring passages or apertures in the mandrel such as used in prior art or conventional die assemblies suffer from the further drawback that they are susceptible to clogging by solidification of the molten metal which is to be cast into the hollow bar. Clogging of the inlet passages or apertures in the die assembly, if unchecked, can cause overflow of the molten metal which presents a most dangerous situation from the standpoint of safety. It also can damage other parts of the casting apparatus contacted by the overflowing molten metal. This becomes very important, for example, when casting hollow copper billets to be used for extruding copper tubing where the production rate may be as high as 8,000 to 12,000 billets per hour.

Another common characteristic of mandrels of the prior art or which are conventionally used in the trade, is that they often are composed of multiple parts which create spaces in the joints between the parts. Should any molten metal enter the spaces, it can cause rupture or deformation of the mandrel requiring replacement or resulting in eccentricity of the mandrel. Moreover, such mandrel assemblies are difficult if not impossible to replace during a commercial on-going casting operation. In addition, multiple piece mandrels can present problems in cooling the mandrels during casting.

Examples of apparatus which suffer from one or more of the drawbacks mentioned above are disclosed in U.S. Pat. Nos. 3,331,430, issued July 18, 1967, 3,735,803, issued May 29, 1973 and 3,710,840, issued Jan. 16, 1973.

OBJECTS OF THE PRESENT INVENTION

It is therefore an object of the present invention to provide novel method and apparatus for continuously casting hollow bars which method and apparatus are free of the above mentioned drawbacks of conventional or prior art apparatus. Although the present invention can be applied with particular advantage to the casting of hollow billets to be subsequently extruded by mechanical means into tubing, the present invention may also be applied to the casting of other products.

Another object of the present invention is to provide novel and improved method and apparatus for continuously casting hollow bars in which the mandrel of the die assembly used to cast the hollow bars, can be quickly and easily replaced during an on-going casting operation.

Another object of the present invention is to provide a novel and improved die assembly including a mandrel for continuously casting hollow bars, which apparatus highly facilitates pouring of the molten metal vertically, directly into the space between the mandrel and the female die included in the die assembly.

Another object of the present invention is to provide novel and improved method and apparatus utilizing a die assembly for continuously casting hollow bars which permits visual inspection of the molten material to be cast while in the die assembly during a casting operation.

Yet another object of the present invention is to provide novel and improved method and apparatus for continuously casting hollow bars which permits the mandrel utilized to form the hollow passage in the bars, to be directly cooled by passage of a cooling medium through the mandrel during the casting operation; the latter serving to prolong the life of the mandrel and to increase production.

A further object of the present invention is to provide novel and improved apparatus capable of continuously casting hollow bars having internal diameters of various sizes including relatively small internal diameters, for example, less than two inches. The latter is highly useful in the formation of hollow copper billets to be mechanically extruded into tubing where heretofore, it has been necessary to pierce the solid billet to initiate the extrusion process which is a costly step because of the wasted copper material and the necessary tooling for piercing and applying great pressure to the billet.

A still further object of the present invention is to provide a novel and improved die assembly for continuously casting hollow bars, which die assembly may be made from relatively few parts and standard die material, such as graphite, and will further successfully function over prolonged periods of use before requiring replacement.

SUMMARY OF INVENTION

According to one embodiment of the present invention, method and apparatus for continuously casting hollow bars are achieved through a one-piece mandrel preferably made from graphite, suspended from a mandrel support bar secured across the top of an open-ended female die having an internal cylindrical forming surface. The mandrel support bar is secured across the top of the female die by means of an annular retaining ring which is secured to a cooler assembly surrounding the female die. The mandrel support bar leaves relatively large crescent-shaped or semicircular open pouring areas permitting easy access by a pouring spout which dispenses molten metal directly into the space between the female die and the mandrel, thereby avoiding the need of providing pouring passages in the mandrel as commonly employed in prior art or conventional structures. The molten material thus introduced in the die assembly is formed by the internal surface of the female die and the external surface of the mandrel, the diameter of the latter governing the diameter of the central passage of the hollow bar to be formed.

Quick connect and disconnect fasteners are employed to secure the mandrel support bar to the retaining ring and, if desired, the support bar may further be secured to the retaining ring by bolts received in the mandrel support bar and fastened in the retaining ring. A pair of guide pins is also provided to project vertically upwardly from the retaining ring to be received through apertures formed in the mandrel support bar so that the support bar with the mandrel installed thereon may be moved along the guide pins into and out of position relative to the female die. The latter structure facilitates installation of a new mandrel during a casting operation because it permits a new mandrel mounted on the support bar to be accurately centered in the center of the female die by pushing the support bar downwardly along the guide pins.

DRAWINGS

Other objects and advantages of the present invention will become apparent from the following more detailed description taken in conjunction with the attached drawings in which:

FIG. 1 is a plan view of apparatus, including a die assembly, embodying the present invention for continuously casting hollow bars and with a portion of a pouring spout broken away;

FIG. 3 is a fragmental, cross-sectional view taken generally along lines 3—3 of FIG. 1; and FIG. 4 is a cross-sectional view taken generally along lines 4—4 of FIG. 1 but with certain parts shown in a position just prior to final installation.

DETAILED DESCRIPTION

Figure 2:
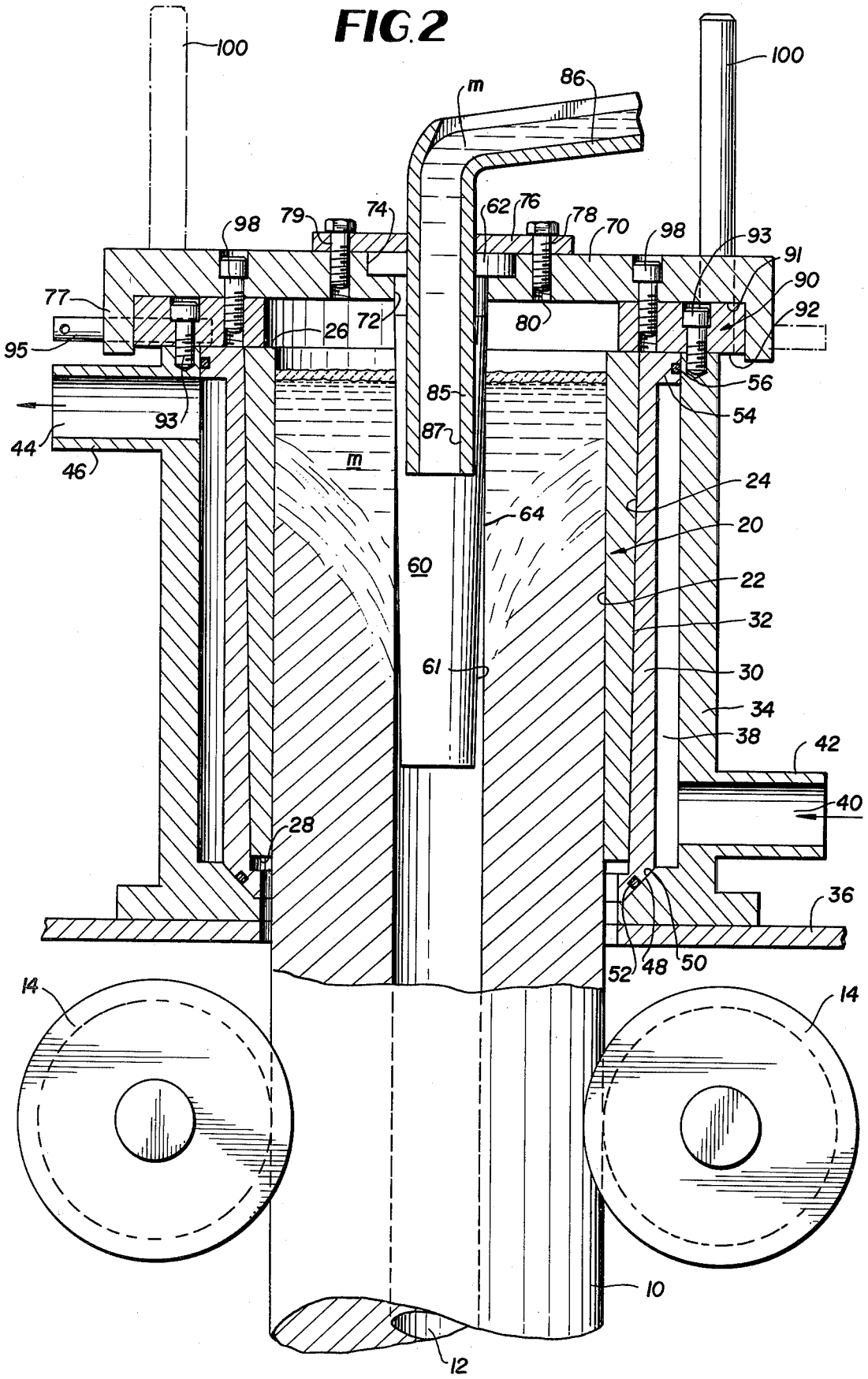
FIG. 2 is a cross-sectional, elevational view taken generally along lines 2—2 of FIG. 1.

Referring now to FIGS. 1 and 2 of the drawings, there is illustrated for illustrative purposes only, apparatus for continuously casting hollow bars, such as that designated 10 in FIG. 2 having a central elongated passage, generally designated 12. Although the present invention is particularly suitable for casting hollow bars made from copper, bars of other material may also be cast with the method and apparatus of the present invention. Referring to FIG. 2, hollow bar 10, upon casting, is drawn downwardly during operation by opposed pairs of pinch roll assemblies, generally designated 14 which form no part of the present invention and need not be described further since they are well-known and used in conventional commercial casting operations.

With continued reference to FIG. 2, the die assembly included in the apparatus of the present invention includes a female die, generally designated 20, preferably made from graphite having a cylindrical internal forming surface 22 and a tapered external surface 24 which is tapered inwardly from the top end 26 of the female die towards the bottom end 28 of the female die. Although, not shown, other female dies having non-cylindrical or polygonal internal forming surfaces may be utilized. Female die 20 is seated within a cooling sleeve 30 which is preferably made from copper for enhanced thermal conductivity and has a tapered internal surface 32 which matches, in a complementary fashion, the external tapered surface 24 of the female die, so that the female die may be firmly seated within the cooling sleeve with continuous and complete contact between the outer surface of the female die and the internal surface of the cooling sleeve as shown in FIG. 2.

Surrounding cooling sleeve 30 is a generally cylindrical cooling jacket 34 which may be made from a suitable material such as steel and is supported on any suitable horizontal structure 36. Cooling jacket 34 is spaced from cooling sleeve 32 to provide an annular space 38 extending throughout the longitudinal extent of the cooling sleeve for receiving a suitable coolant, such as water. The latter may be introduced through an inlet passage 40 formed by fitting 42 and discharged by a discharge passage 44 formed by a fitting 46. The lower end portion of cooling jacket 34 is formed with a conical seat 48 for receiving the lower end of cooling sleeve 30 which is formed with a similarly tapered surface 50 for contacting seat 48 as best shown in FIG. 2. A suitable sealing means such as an O-ring 52 is utilized between the contacting surfaces at the lower ends of the cooling sleeve and jacket. In the specific embodiment shown, the upper end of cooling sleeve 30 is formed with an outwardly extending radial flange 54 in which is located a suitable sealing means such as an O-ring 56 for sealing the upper end of coolant chamber 38.

The central longitudinal passage 12 formed in the bar 10 which is cast, is formed through means of a mandrel generally designated 60. Although mandrel 60 is preferably formed from graphite material, other standard materials such as steel or glass may also be employed. Mandrel 60 has, for a substantial portion of its length, an inverted frustoconical shape so as to present a downwardly and inwardly tapering external surface 61 from which the molten material to be cast will separate such as, for example, at point 64 shown in FIG. 2 during formation of the casting. Mandrel 60 is preferably formed as a one-piece structure and is supported within female die 20 by a novel mounting means in accordance with the present invention.

In accordance with a preferred embodiment of the present invention, the mandrel mounting means includes what will be referred to as a "mandrel mounting bar" or a "mandrel support bar" 70 which may be formed from steel to extend diametrically across the top open end of female die 20 as best shown in FIGS. 1 and 2. Mandrel support bar 70 is provided with a passage 72 extending vertically therethrough for receiving mandrel 60. In the shown embodiment where it is desired to position mandrel 60 coaxially or concentric relative to the longitudinal axis of female die 20, the mandrel receiving passage 72 formed in mandrel support bar 70 is located accordingly to achieve that desired location of mandrel 60 in the female die 20. Further, in the specific embodiment shown, mandrel 60 is supported in mandrel support bar 70 against downward movement by means of a recess 74 formed as part of mandrel receiving passage 72 so as to receive an enlarged head 62 formed at the top of mandrel 60. Head 62 has a generally circular shape projecting radially from the mandrel body so as to be seated within recess 74 of the mandrel support bar, as best shown in FIG. 2. Mandrel 60 is secured in mandrel support bar 70 against upward movement relative to support bar 70 in the shown embodiment by means of a stop shown in the form of a flat bar 76 extending over the top surface of mandrel head 62 which is coplanar with the top surface of support bar 70. Stop bar 76 is releasably secured to the mandrel support bar by any suitable means, such as threaded bolts 78 which are received through apertures 79 formed in stop bar 76 and into threaded passages 80 formed through the mandrel support bar.

Referring to FIG. 1, in order to accommodate seating of mandrel head 62 in mandrel support bar 70, the central portion of mandrel support bar 70 is formed with convexly circularly curved, laterally projecting portions 71 in which is formed recess 74 for receiving mandrel head 62. The remaining portions of mandrel support bar 70 which extend outwardly away from the central portion of the mandrel support bar are formed with a rectangular cross section having a minimum width so as to leave relatively large escaloped or crescent shaped openings 84 on opposite sides of the mandrel support bar through which a molten metal pouring spout 85 may easily be positioned such as shown in FIG. 1. In the specific form shown, spout 85 has an open trough-like top portion 86 extending at an incline across the top of the die assembly and a lower tubular portion 87 extending vertically through one of the crescent sloped areas 84 on either side of mandrel support bar. The lower end of spout portion 87 communicates directly with the space between female die 20 and mandrel 60 so as to be capable of delivering molten metal m such as copper into that region.

In the preferred form of the invention, mandrel support bar 70 is releasably secured relative to female die 20 so as to properly position mandrel 60 within the female die, by means of a retaining ring 90 having upper and lower flat horizontal surfaces 91 and 92 for contacting the bottom flat surface of mandrel support bar 70 and the upper flat coplanar surfaces presented by the upper ends of the cooler assembly 30, 34 and female die 20, as best shown in FIG. 2. In the shown embodiment, retaining ring 90 is secured relative to the cooler assembly by means of threaded bolts 93 received through passages formed in the retaining ring and threaded into passages formed in the walls of cooling jacket 34, as best shown in FIG. 2.

Quick connect and disconnect means are provided between mandrel support bar 70 and retaining ring 90 for effecting simple and quick interconnection or release between these parts. In the specific embodiment shown, this is achieved through depending lugs 77 formed on the opposite ends of mandrel support bar 70 (see FIGS. 2 and 3) so as to be located outwardly of retaining ring 90, and pins 95, such as in the form of dowels, receivable through alignable passages 96 and 97 formed in lugs 77 and retaining ring 90, as best shown in FIG. 3. Insertion of pins 95 through lugs 77 and into retaining ring 90 will, of course, secure these parts against separation while removal of pins 95 will permit release of mandrel support bar 70 and retaining ring 90.

Should it be desired to further secure mandrel support bar 70 against movement, threaded bolts 98 may be inserted through apertures in mandrel support bar 70 and fastened in corresponding threaded apertures in retaining ring 90 as shown in FIGS. 1 and 2. In the event a quick connect or disconnect capability is required between mandrel support bar 70 and the retaining ring 90, bolts 98 may be excluded. The latter is particularly useful when it is desired to change or replace mandrel 60 during an on-going casting operation where quick disconnect and connect pins 95 become highly useful.

Referring to FIG. 4, in order to facilitate installation of mandrel 60 within the female die 20 in the desired position which, in the specific form, is centered or coaxially related to the vertical axis of female die 20, a pair of guide pins 100 are fixed to retaining ring 90 to project upwardly therefrom in a vertical plane so as to receive the mandrel bar which is formed with through passages 102 which receive the guide pins. During assembly of mandrel support bar 70 and mandrel 60 relative to the female die 20, once guide pins 100 are received in passages 102 of the mandrel support bar, the latter bar may be lowered along guide pins 100 until it contacts the upper surface 91 of the retaining ring 90, at which time mandrel 60 will have been properly positioned with accuracy within the female die.

To summarize installation of the die assembly, and assuming cooling jacket 34 and cooling sleeve 30 have been assembled relative to each other, female die 20 is first inserted within cooling sleeve 30 and seated properly therein by virtue of the complementary tapered surfaces thereof. Retaining ring 90 is then secured to cooling jacket 34 by means of bolts 93. Mandrel 60 is inserted vertically downwardly through passage 72 in mandrel support bar 70 until mandrel head 62 is seated in recess 74. Stop plate 76 is secured across the top of mandrel head 62 by means of bolts 78. Mandrel support bar 70 is then placed over female die 20 with the guide pins 100 received through passages 102 of the mandrel support bar as shown partly in FIG. 4. Mandrel support bar 70 may then be grasped with the hands and moved downwardly as shown by the arrow in FIG. 4 to seat the mandrel support bar on the upper surface 91 of retaining ring 90 which will automatically place mandrel 60 in the proper centered position within female die 20. Quick connect pins 95 may then be inserted through lugs 77 of mandrel support bar 70 and into retaining ring 90 as shown in FIG. 3. If it is further desired to secure the mandrel support bar, bolts 98 may be secured through the mandrel support bar and into the retaining ring.

When it is desired to replace a mandrel 60 during an ongoing casting operation, pins 95 are removed from retaining ring 90, and mandrel support bar 70 with its mandrel 60 is removed upwardly along guide pins 100. Another mandrel support bar (not shown) containing the replacement mandrel (not shown) already mounted in place may then be quickly mounted on guide pins 100 and pressed downwardly to force the mandrel through the molten metal m in the female die. Portions of the cast bar 10 formed during the interval between removal of the prior mandrel and insertion of the replacement mandrel may be cut away from the cast bars at a later time.

It will be seen from the above that the present invention not only permits hollow cast bars to be continuously formed with small or large internal diameters as is desired, but furthermore, it provides large pouring spaces 84 above female die 20 into which a pouring spout such as 85, may be inserted for introducing molten metal m directly into the upper regions of the female die in the space between the latter and the mandrel 60. This does away with the necessity of cumbersome or complicated mandrels including multiple piece mandrels with pouring apertures or passages formed therein as has been done in prior art or conventional mandrels. In addition, the present invention permits the mandrel to be made in one piece from graphite material or any other suitable material. It will further be seen that the large pouring spaces 84 also permit visual inspection of the molten material while in the female die during a casting operation. In addition, the formation of the mandrel and the mandrel support structure permits other, hollow mandrels (not shown) to be utilized with a cooling system (not shown) for circulating cooling medium through the mandrel during the casting operation to prolong the life of the mandrel and to increase the rate of production.

In one specific embodiment where the female die has an internal diameter of seven and one-half inches so as to form a hollow metal bar 10 having an outside diameter of seven and one-half inches, the width of the mandrel support bar may be about one and one-half inches, thereby leaving a maximum of three inches between the opposite sides of the mandrel support bar and the internal surface 22 of the female die 20. The width of the mandrel may be designed so as to produce an internal diameter in the cast bar as small as two inches or less than two inches. In one specific embodiment, the taper of mandrel 60 may be one degree—thirty seconds per lineal inch of mandrel. Hollow copper bars with small internal diameters produced by the die assembly of the present invention may be extruded by means of a hydraulic ram (not shown) to form copper tubing; the small initial internal diameters of the bars facilitating the start of the extrusion process. Of course, it will be understood that the present invention may be utilized to cast hollow bars with relatively large internal diameters if desired. Moreover, any other metals than copper may be utilized with the present invention to form the desired product.

What is claimed is:

1. A die assembly for continuously casting hollow bars, the assembly comprising in combination, a female die having upper and lower open ends and having a vertical passage including an internal forming surface for receiving molten material to be formed into a hollow bar, an elongated mandrel support member fixed relative to the female die and extending across the top of the female die and defining with the internal surface of the female die relatively large unobstructed areas for pouring molten metal directly into the passage of the female die from the top end thereof and to the side and independently of the mandrel support member, a one-piece solid and unapertured mandrel removably fixed to the mandrel support member and suspended therefrom to be received within the passage of the female die for forming a hollow passage in the hollow bar to be cast, guide means projecting above opposite side portions of the female die and guide passages in opposite end portions of the mandrel support member receiving said guide means for vertically placing said mandrel support member and the mandrel in position with the mandrel received through the molten metal in the die during a casting operation, and wherein there is further included a retaining ring fixed relative to the female die about the upper end thereof, and wherein said mandrel support member and said retaining ring have alignable passages and wherein there is further included a fastening element slidably received in said alignable passages to releasably fix the mandrel support member to said retaining ring while permitting quick release of the mandrel support member from the retaining ring.

2. The assembly defined in claim 1 wherein said mandrel support member has a passage extending therethrough intermediate the ends thereof for removably receiving an upper portion of the mandrel.

3. The assembly defined in claim 2 further including means preventing movement of the mandrel relative to the mandrel support member in one direction.

4. The assembly defined in claim 3 further including means preventing movement of the mandrel relative to the mandrel support member in a direction opposite the said one direction.

5. The assembly defined in claim 3 wherein said means preventing movement of the mandrel relative to the support member in said one direction includes an enlarged head formed on the upper end of the mandrel and a recessed seat formed in said passage in the mandrel support member for receiving said mandrel head.

6. The assembly defined in claim 5 further including a stop removably fixed to the top of the mandrel support member to overlie said passage in the mandrel support member and said head of the mandrel to prevent movement of the mandrel relative to the mandrel support member in a direction opposite to said one direction.

7. The assembly defined in claim 1 further including a second pair of alignable passages extending in said mandrel support member and retaining ring and wherein there is further included a second fastening element receivable in said last-defined alignable passages to further secure the mandrel support member relative to the retaining ring.

8. The assembly defined in claim 1 further including a cooler assembly surrounding said female die for circulating coolant fluid about the female die and wherein said retaining ring is fixed to said cooler assembly.

9. The assembly defined in claim 8 wherein said cooler assembly includes an inner cooling sleeve received about the female die with the female die seated against an internal surface of the cooling sleeve, and an external cooling jacket surrounding said cooling sleeve, and wherein said retaining ring is fixed to said jacket.

10. The assembly defined in claim 1 wherein said guide means includes a paair of guide pins fixed to said retaining ring and upstanding upwardly therefrom in a vertical plane for receipt in said guide passages of said mandrel support member.

11. The assembly defined in claim 8 wherein said mandrel support member has a passage therein receiving an upper portion of said mandrel.

12. In the process of continuously casting hollow bars from a female die having an internal through passage, and a mandrel extending longitudinally in said passage of the female die and spaced from internal surfaces of the female die to define a forming chamber; the method of installing and locating the mandrel in a predetermined position within the passage of the female die during a casting operation comprising the steps of; mounting the mandrel to a mandrel support member having guide apertures on opposite end portions thereof, providing guiding pins vertically upstanding from the upper end of the female die, placing the mandrel support member on the guide pins with the guide pins received in the apertures of the mandrel support member, and grasping the mandrel support member and moving the mandrel support member downwardly towards the female die under the guidance of said guide pins to force the mandrel through molten metal in the female die to position the mandrel within the female die.

* * * * *